US005974693A

United States Patent [19]

Richards et al.

[11] Patent Number: 5,974,693

[45] Date of Patent: Nov. 2, 1999

[54] FOOTWEAR DRYING RACK AND METHOD FOR ITS USE

[76] Inventors: Russell F Richards, 223 N. Harbor Dr., Holmes Beach, Fla. 34217; Robert E. Schomberg, 1117 32nd Ave. Dr. E., Ellenton, Fla. 34222

[21] Appl. No.: 09/133,111

[22] Filed: Aug. 12, 1998

[51] Int. Cl.[6] ..... F26B 11/00

[52] U.S. Cl. ..... 34/600; 34/184

[58] Field of Search ..... 34/600, 239, 595

[56] References Cited

U.S. PATENT DOCUMENTS 5,365,675 11/1994 Shabram, Jr. ..... 34/109
5,398,428 3/1995 Wallace ..... 34/600

*Primary Examiner*—Henry Bennett
*Assistant Examiner*—Malik N. Drake
*Attorney, Agent, or Firm*—Dorothy S. Morse

[57] ABSTRACT

A footwear drying rack and a method for its use within automatic dryers having a rotating drum, the framework of the rack having one outwardly spring-biased main actuator arm and one telescoping main actuator arm placed in opposition thereto; two rack holders secured to opposite sides of the inside surface of the dryer drum and between which the two main actuator arms are firmly fixed during use; and a plurality of outwardly spring-biased shoe bracket subassemblies upon which wet footwear may be placed to allow the footwear to dry within an automatic clothes dryer more rapidly than if it were placed loose within the dryer drum. Since the footwear remains attached to the rack during the entire time it is being dried, air circulates evenly about it thereby reducing damage to the footwear, and it is not allowed to contact the dryer drum and door which can cause an undue amount of noise, mar and dent the dryer's walls and door, cause the motor to burn up if the laces become sufficiently entangled in the drum to stop it, and periodically knock open the clothes dryer door to interrupt the drying cycle and cause drying delay. Applications may include, but are not limited to, the drying of shoes belonging to both children and adults, work boots, steel-tipped shoes, and athletic footwear including shoes having spikes and cleats that are commonly used in the sports of baseball, softball, football, golf, hiking, and mountain climbing.

11 Claims, 10 Drawing Sheets

FOOTWEAR DRYING RACK AND METHOD FOR ITS USE

BACKGROUND

1. Field of Invention

This invention relates to devices used for drying footwear, specifically to a footwear drying rack and a method for its use within automatic clothes dryers having a rotating dryer drum, the framework of the rack comprising one outwardly spring-biased main actuator arm and one telescoping main actuator arm positioned in opposition thereto, two rack holders which are secured to opposite sides of the inside surface of the dryer drum and between which the two main actuator arms are firmly fixed during use, the framework also comprising a plurality of outwardly spring-biased shoe bracket subassemblies upon which wet footwear may be placed to allow such footwear to dry within the automatic clothes dryer in a shorter amount of time than if it were placed loose within the dryer drum, and to also cause drying of the footwear without it repetitively striking the inside surfaces of the clothes dryer door and drum, whereby such repetitive contact might otherwise cause an undue amount of noise, damage to the shoes, marring and denting of the inside walls and door of the clothes dryer, burning up of the dryer motor if laces attached to the boots or shoes became sufficiently entangled in the drum to stop it, and interruption of the drying cycle if the loose footwear were to knock open the clothes dryer door. Applications may include, but are not limited to, drying of shoes belonging to both children and adults, work boots, steel-tipped shoes, and athletic footwear including shoes having spikes and cleats that are commonly used in the sports of baseball, softball, football, golf, hiking, and mountain climbing.

2. Description of Proir Art

Wet footwear is periodically encountered by almost everyone, and a wide variety of methods and devices have been tried to dry wet footwear without damaging it. Air drying of wet footwear is slow, and can lead to undesirable odors in the footwear, even if a quantity of newspaper or other absorbent material is initially placed in the toes of the footwear to draw out excess moisture. To accelerate drying time, people have been known to place wet footwear near to a heat source, such as a fire place or stove, whereby the footwear becomes subject to hot spots, burned and scorched heels and soles, and shrinking. Further, even though a wide variety of devices are known to dry footwear which attach to hair dryers or have various combinations of electric heaters, flexible air hoses, and electric blowers, as a matter of convenience many people choose to dry footwear in automatic clothes dryers, however, in doing so they can experience a variety of problems. For example, footwear placed loose within automatic clothes dryers tends to bang and knock against the inside walls and door of the dryer drum. When heavy shoes and boots are dried, the noise created by the repetitive banging and knocking can be bothersome. Further, particularly when steel-tipped shoes or boots, and shoes having spikes or cleats, are dried, the inside surfaces of the dryer drum and door become subject to marring and denting. Also, footwear placed loose within a clothes dryer does not dry evenly and will therefore take an excessive amount of time to become completely dry, unnecessarily consuming energy resources. Another problem is that if time is not taken to loosen or remove the laces found in many types of boots, shoes and sneakers, the laces can become sufficiently entangled with the drum to cause the drum to get stuck. This can lead to overheating and possible failure of the dryer's motor. In addition, wet and dry footwear tends to knock clothes dryer doors open mid-cycle, which can lead to drying delays. It also requires the periodic attention from someone to restart the dryer.

Use of the present invention to dry footwear secures it in a stationary position relative to the inside walls of an automatic clothes dryer drum, and eliminates all of the above mentioned problems. The wet footwear is positioned upon a rack which circles at the same speed and direction of rotation as the dryer drum which helps to promote even footwear drying and prevents one part of the footwear becoming excessively hot relative to the remainder of the footwear, which can otherwise lead to damage. Also, the wet footwear does not have the opportunity to contact the inside surface of the dryer drum, therefore the drum and door of the clothes dryer do not become dented or marred. Also, the opportunity is avoided for shoe and boot laces to become entangled with the dryer drum and possibly cause motor failure. In addition, the outwardly spring-biased shoe bracket applies pressure to a wet shoe or boot between the inside surface of its heel and its toe to help prevent shrinking of the footwear during the drying cycle. Also, when the present invention is used the secured shoes and boots cannot knock open the dryer door mid-cycle and the flow of forced hot air is evenly circulated around the wet footwear as the drum turns, to accomplish prompt drying of the footwear without an unnecessary expenditure of energy resources. It is not known to have a footwear drying rack comprising one outwardly spring-biased main actuator arm and one telescoping main actuator arm placed in opposition thereto, two rack holders which are secured to opposite sides of the inside surface of the dryer drum and between which the two main actuator arms are firmly fixed during use, the framework also comprising a plurality of outwardly spring-biased shoe bracket subassemblies upon which wet footwear may be placed to allow such footwear to dry within the automatic clothes dryer in a shorter amount of time than if it were placed loose within the dryer drum.

SUMMARY OF INVENTION—OBJECTS AND ADVANTAGES

It is the primary object of this invention to provide a footwear drying device for use in automatic clothes dryers which accommodates a variety of sizes and types of footwear and is configured to reduce the time required for footwear drying. It is also an object of this invention to provide a footwear drying device that is adjustable for use in more than one size of automatic clothes dryer drum. It is a further object of this invention to provide a footwear drying device for use in automatic clothes dryers that helps to prevent shrinking of wet footwear as it is dried. A further object of this invention is to provide a footwear drying device for use in automatic clothes dryers which prevents the footwear from damaging the interior surfaces of the dryer drum and door, also prevents the footwear from knocking the dryer door open mid-cycle. It is also an object of this invention to provide a footwear drying device for use in automatic clothes dryers which prevents laces attached to the footwear from becoming entangled with the dryers rotating drum and causing the drum to become stuck, so that the dryer's motor is not subjected to an unnecessary cause of failure. It is a further object of this invention to provide a footwear drying device for use in automatic clothes dryers which is made from strong, heat-resistant materials which do not warp or bend upon becoming heated to the temperature levels common to household clothes dryers, but materials which are also light in weight to reduce the load placed upon the dryer's belts and motor when heavy wet work boots and sneakers are placed upon the rack at the beginning of the drying cycle.

As described herein, when properly manufactured and installed, the footwear drying rack of the present invention would preferably be made out of rigid materials such as molded thermoplastics, PVC materials, or aluminum to provide a sturdy device upon which heavy wet shoes, boots, and sneakers can be secured to dry them in an automatic clothes dryer in positions wherein they cannot come in contact with the dryer walls and door. The outwardly spring-biased shoe bracket subassemblies, over which the individual pieces of footwear are each supported between its heel and toe, keep the footwear in a stationary position relative to the dryer drum during the entire time the footwear is being dried, so that air can circulate evenly about it to promote faster drying and cause less shrinkage than if the footwear were left loose within the dryer drum where it might be subject to hot spots. Thus, the present invention promotes prompt drying of the footwear without an unnecessary expenditure of energy resources. The wet footwear is positioned upon a rack which circles at the same speed and direction of rotation as the dryer drum which also helps to promote even footwear drying to prevent one part of the footwear becoming excessively hot relative to the remainder of the footwear, which can lead to damage. The arm of each shoe bracket subassembly is adjustable to accommodate shoes and boots whose uppers differ in height, such as through outwardly spring-biased means or through a telescoping type of construction. It is contemplated for the preferred embodiment of the rack to have one outwardly spring-biased main actuator arm and one telescoping main actuator arm placed in opposition thereto; two rack holders secured to opposite sides of the inside surface of the dryer drum and between which the two main actuator arms are firmly fixed during use; and a plurality of outwardly spring-biased shoe bracket subassemblies upon which the footwear is placed. Since the footwear is not allowed to contact the dryer drum and door, no loud banging noises are experienced. Also, shoes with spikes and cleats, as well as steel-toed shoes and boots, can be dried without the possibility of them marring and denting the dryer's drum walls and the dryer door. Further, laces do not contact the dryer drum, eliminating the risk of the laces becoming sufficiently entangled in the drum to stop it and cause motor or belt failure. Also, when using the present invention, the person attempting to dry footwear does not have to devote part of his or her attention to periodically checking of the clothes dryer door to confirm that the drying cycle has not been interrupted by loose footwear knocking open the dryer door.

The description herein provides preferred embodiments of the present invention but should not be construed as limiting the scope of the footwear drying rack invention. For example, variations in the size of springs or actuators used to outwardly bias both the shoe brackets and the main actuator arms, the cross-sectional configuration of the shoe brackets and the main actuator arms, the number of vent holes used, the material from which the rack holders are made, the means used to attach the rack holders to the inside surface of the dryer drum, the type of bonding and welding methods and materials used to bond or weld together the various parts and subassemblies used to fabricate the complete dryer rack, and the number and size of shoe brackets used, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

Figure 1:
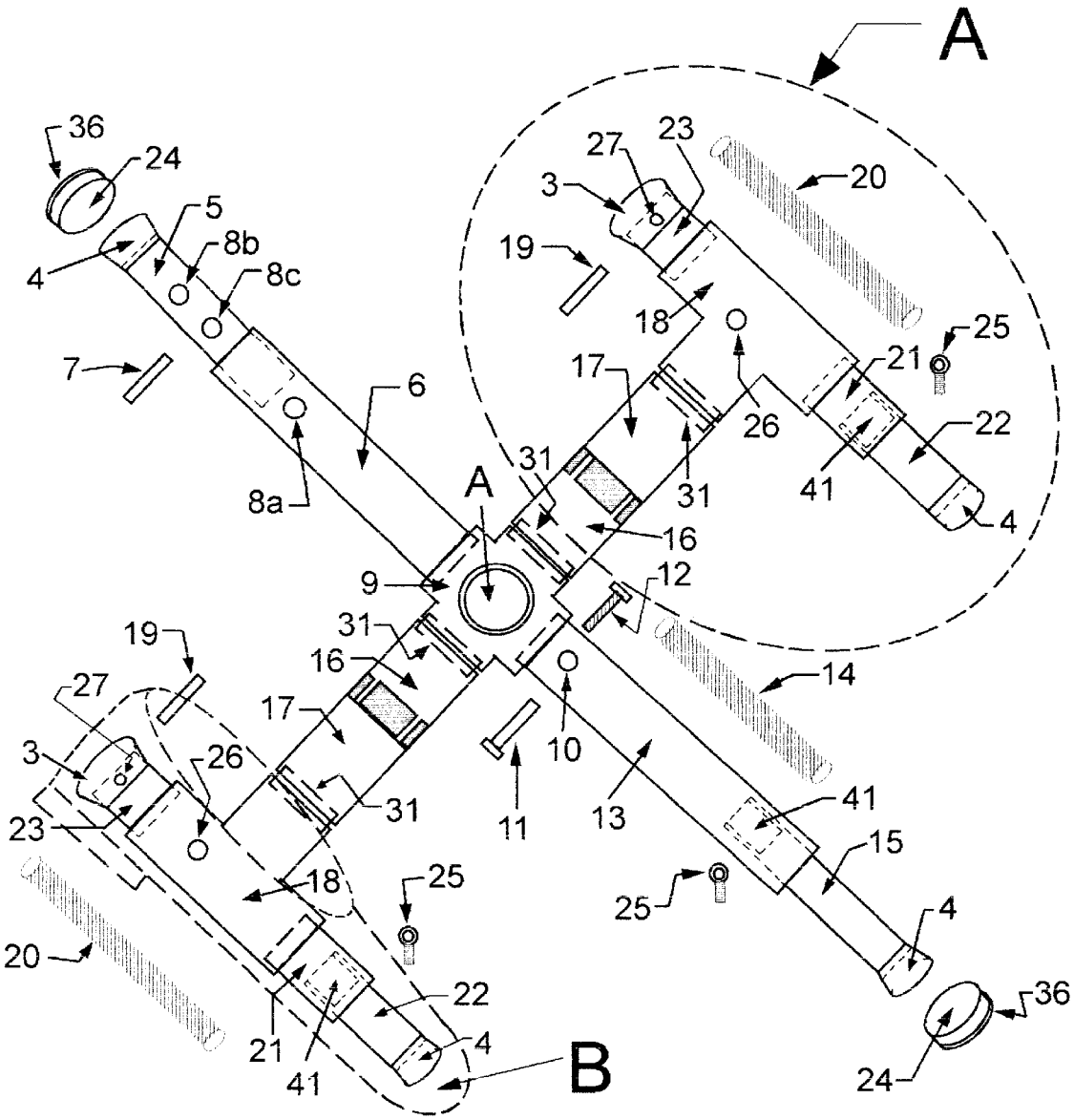
FIG. 1 is a top view of a first preferred embodiment of the present invention having a main spring-biased arm and a telescoping main actuator arm, with two of the four shoe bracket subassemblies that form the complete invention connected thereto. "B" is an outline of one piece of footwear mounted on one of the shoe bracket subassemblies "A".

The first preferred embodiment of the footwear drying rack is shown in FIG. 1, and is preferably made from preformed PVC components or other molded plastic materials. The first embodiment comprises four shoe bracket subassemblies "A" and is supported for use by a spring-biased main actuator arm comprising in part a sliding actuator arm 5, and an actuator plunger 15.

The components that make up the main actuator arm are pictured in FIG. 1 and include a first ½" diameter foot 4, a sliding actuator arm 5, a sliding actuator housing 6, a sliding actuator housing pin 7, several sliding actuator housing fastener holes 8, a six-way hub 9, a main spring housing fastener hole 10, a female part of main actuator spring fastener 11, a male part of main actuator spring fastener 12, a main spring actuator housing 13, a main actuator spring 14, a main actuator plunger 15, a spring fastener 25, and a second ½" diameter foot 4.

Figure 5:
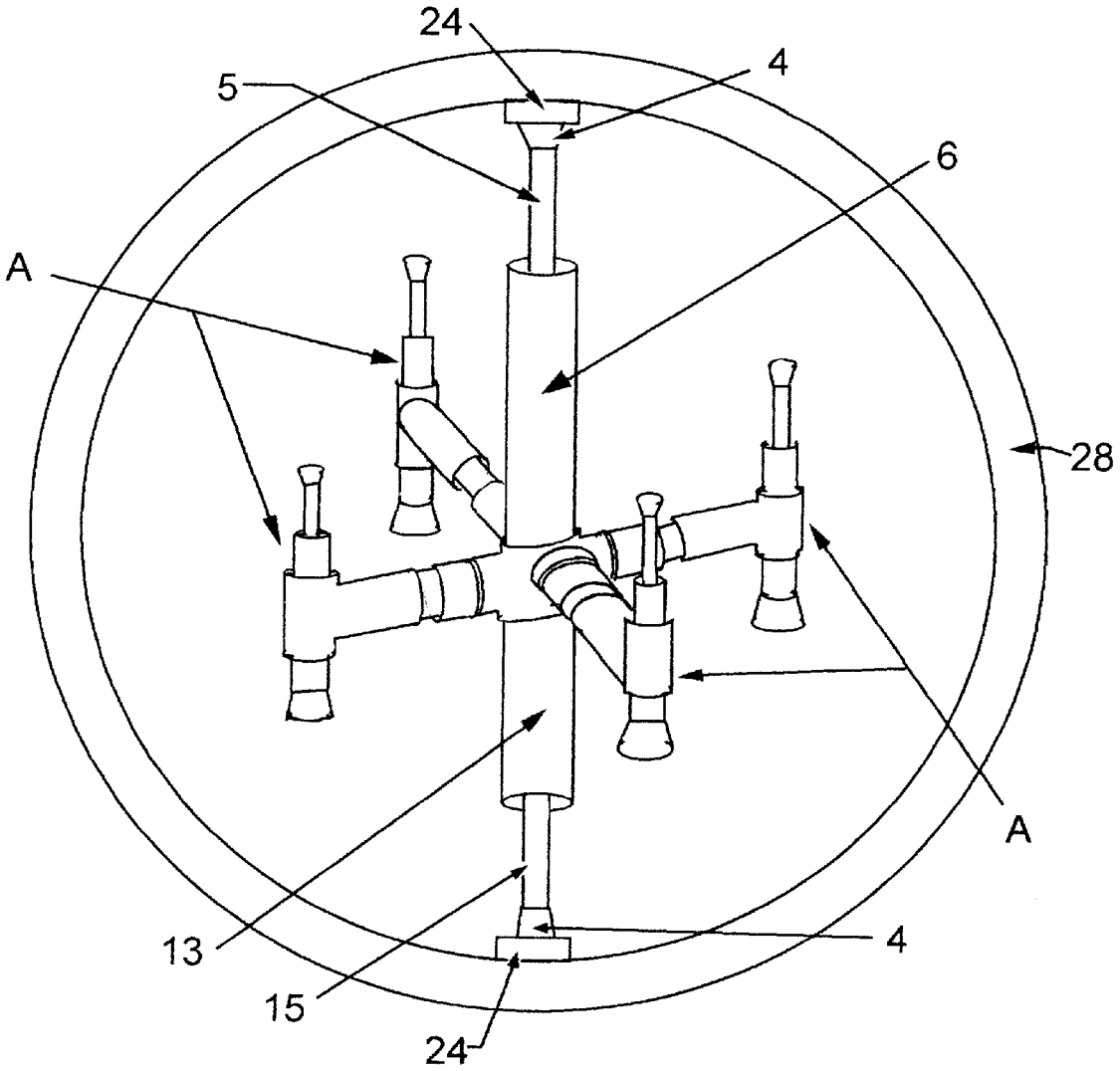
FIG. 5 is perspective view of the first embodiment of the invention when it is placed between two rack holders mounted on the inside surface of an automatic dryer drum.

The first foot 4 is made of plasticized rubber and fits over the end of the sliding actuator arm 5 losest to hole 8*b* on arm 5. Each foot 4 used helps to prevent slippage of the invention during use in automatic dryer drums such as drum 28 shown in FIG. 5. Sliding actuator arm 5 is an adjustable arm that slides within sliding actuator housing 6. The sliding action of sliding actuator arm 5 within sliding actuator housing 6 allows for the adjustment in length of the present invention. This sliding action allows the present invention to fit into automatic clothes dryers whose inside drum diameters vary between twenty-three and thirty inches.

There is one sliding actuator housing fastener hole 8*a* drilled into the surface of sliding actuator housing 6, and two holes 8*b* and 8*c* drilled into sliding arm 5 at the approximate positions as depicted in FIG. 1. These holes allow for the adjustment of the length of the footwear rack so that the rack can fit the inside diameter of dryer drums 28 having different diameters. Although more holes such as 8*a*, 8*b*, and 8*c* are within the scope of the present invention, when placed as shown in FIG. 1, holes 8*a* through 8*c* are sufficient to make the present invention fit most sizes of dryer drums 28 in common use today. During use housing pin 7 is inserted into hole 8*a* in sliding actuator housing 6 then into either hole 8*b* or 8*c* on sliding arm 5 as determined by the diameter of dryer drum 28.

Although not shown, prior to assembly PVC cleaner and PVC cement are applied to the outside end surface of the open end of sliding housing 6, then PVC cleaner and PVC cement is applied to the inside surface of one of the connector openings in hub 9. The end of sliding actuator housing that is opposite to holes 8*b* and 8*c* is now inserted into the prepared end of hub 9.

Figure 3:
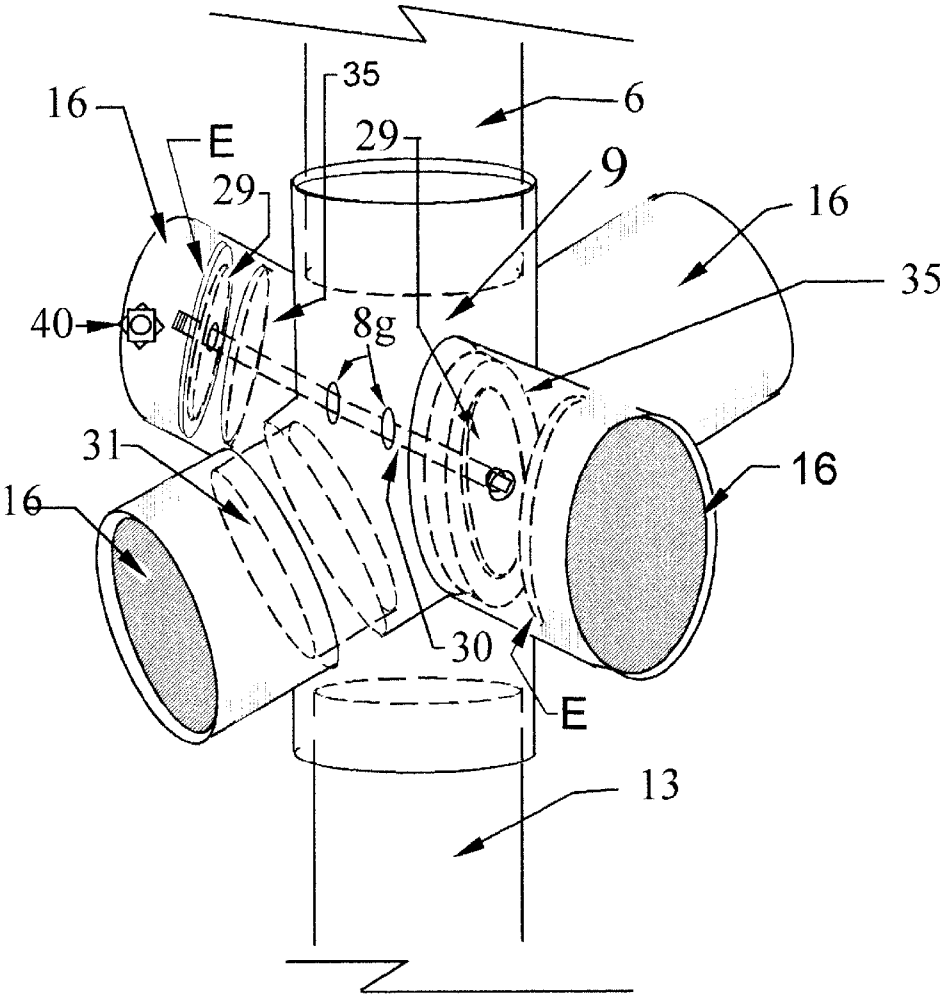
FIG. 3 is an isometric view of the six-way hub identified as Numeral 9 in FIG. 1, and to which the spring-biased main actuator arm, the telescoping main actuator arm, and the shoe bracket subassemblies "A" are attached.

The assembly of hub 9 is shown in FIG. 3. With the hub 9 laying flat on a work surface (not shown) a ⅛" hole 8*g* is drilled completely through the center of hub 9. One washer 29, is inserted into the unthreaded end of one of the two ¾" female PVC couplers 16 used, and seated against a stop "E" on the inside of coupler 16, FIGS. 3 and 9. PVC cleaner and PVC cement are applied to the outside surface of one washer lock ring 35. The prepared ring 35 is now inserted into the unthreaded end of coupler 16 and pushed into it until aluminum washer 29 is seated against the stop "E" in coupler 16. A second coupler 16 is prepared in the same manner as described above. The unthreaded ends of prepared couplers 16 are now shaped, FIG. 9 "D", to fit the curvature of the top and bottom of the four connectors that make up hub 9, see FIG. 9. A 2½" aluminum bolt 30 is now inserted into the threaded side of the first prepared coupler 16, FIGS. 3 and 9, through stop E, through washer 29, through ring 35, through shaped side of first prepared coupler 16. The bolt is now inserted completely through hub 9 at location "A" FIG. 1 (location "A", where the first two prepared couplers 16 are to be fixed to hub 9, is perpendicular to plane of FIG. 1—not shown in FIG. 1, see FIG. 3), through the shaped side of second coupler 16, FIG. 3, on opposite side of hub 9, through second ring 35, through second washer 29, through second stop E, and out the threaded interior of second coupler 16. Nut 40 is screwed onto the threaded side of bolt 30 and tightened until the two prepared couplers 16 are fixed tight to hub 9.

The end of main spring actuator housing 13 closest to hole 10, and the inside surface of the connector on hub 9 opposite sliding housing 6 are both prepared with PVC cleaner and PVC cement. The end of the spring actuator housing 13 closest to hole 10, FIG. 1, is inserted a distance of approximately one-half inch into the prepared connector of hub 9.

Figure 7:
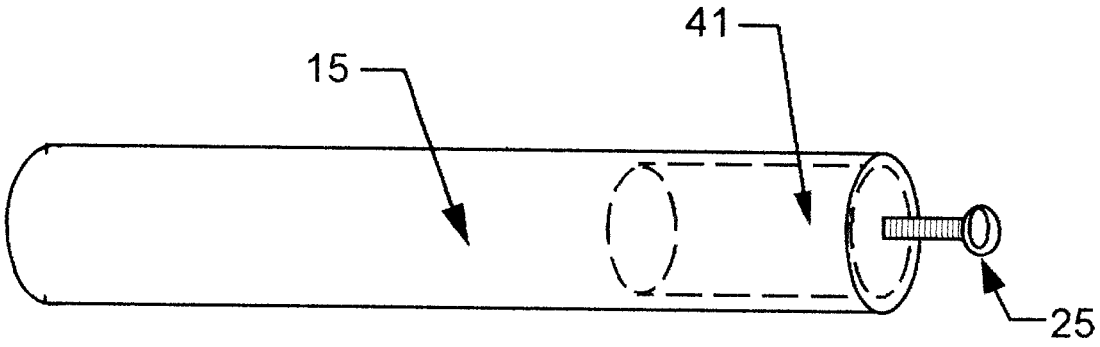
FIG. 7 is a side view of the assembly of the main actuator plunger used in the first embodiment of the invention.
Figure 8:
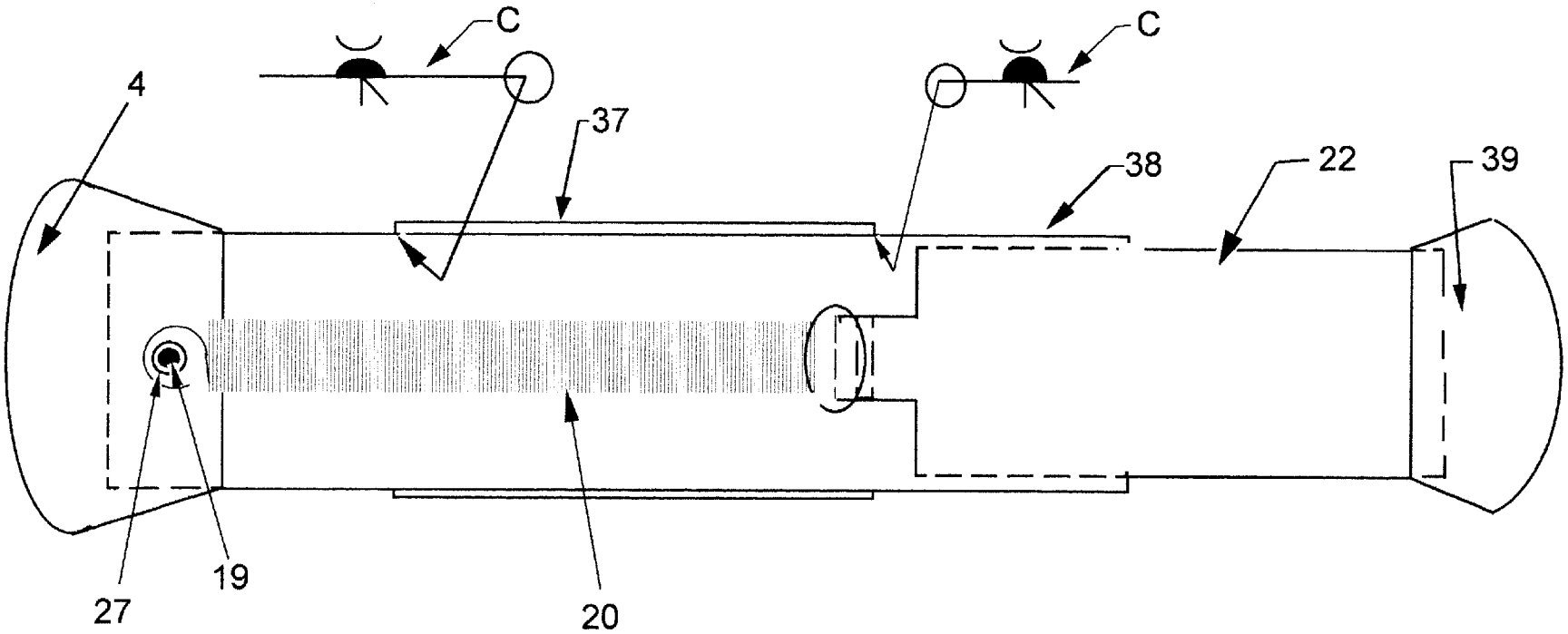
FIG. 8 is an enlarged view of the shoe bracket subassembly "F" of the second embodiment.

A 3" length of wood dowel 41 is inserted into one end of main actuator plunger 15 until the two faces are even and cemented in place. A spring fastener 25 is screwed into the wood dowel 41 that was inserted into plunger 15. FIG. 7 is a side view of the assembling of dowel 41, plunger 15, and fastener 25. Plunger 15 and fastener 25 are then attached to one of the loops in spring 14. The free end of spring 14, spring fastener 25, and attached plunger 15 are inserted into the open end of main spring actuator housing 13 and fixed at the location of the main spring housing fastener hole 10 located approximately 11" from plunger 15 end of main spring actuator housing 13, by the male and female parts of a two part spring fastener designated by the numbers 11 and 12 respectively. Second foot 4 is then fitted onto the open end of the main actuator plunger 15 to prevent slippage of footwear rack in rack holder 24.

Figure 9:
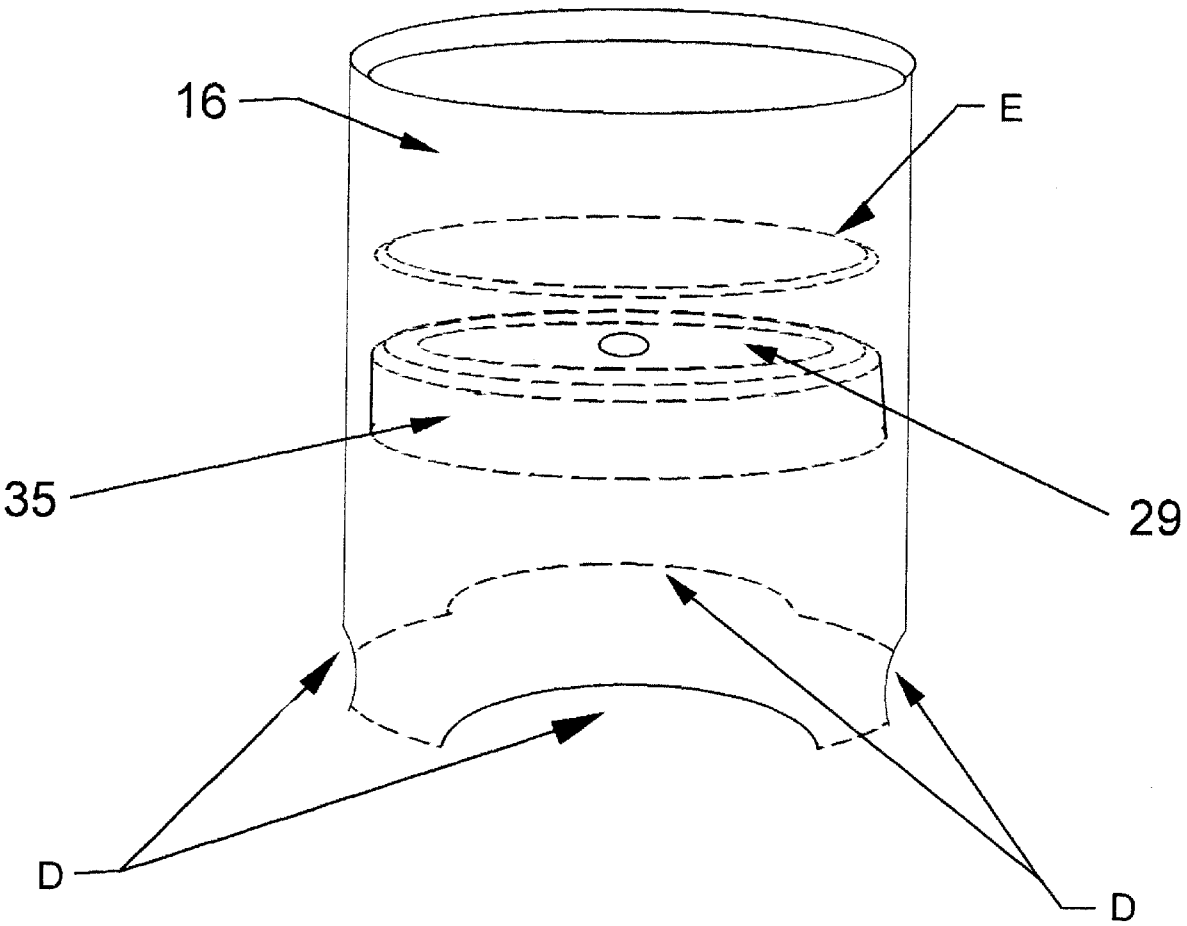
FIG. 9 is a projection of a female coupler of first embodiment showing shaping of unthreaded end.
Figure 10:
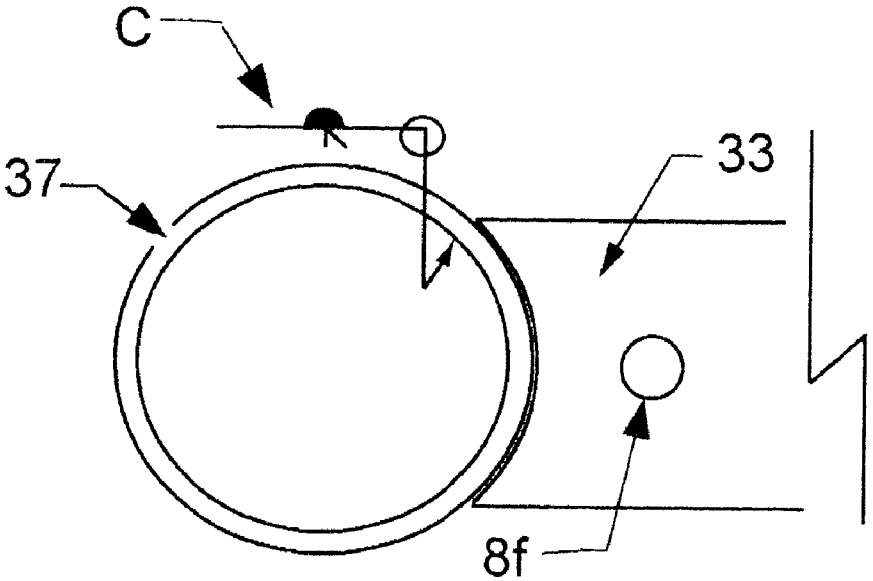
FIG. 10 is a sectional view of positioning and welding of sliding arm to housing in second embodiment.

The last two female couplers 16 are attached to hub 9, FIGS. 3 and 9, by applying PVC cleaner and PVC cement to the inside surface of the two remaining openings in hub 9, the outside surface of two connectors 31, and to the inside unthreaded end of the two remaining female couplers 16. One end of connectors 31 is then inserted ½" into the two remaining openings in hub 9. The unthreaded ends of female couplers 16 are then fitted over the open ends of connectors 31.

The outside circumference of connector 31 is cemented to the inside circumference of the unthreaded end of male coupler 17. The same connector 31 is then cemented to the inside circumference of the one right angle connector of shoe "T" coupler 18. Shoe bracket actuator housing (rear) 23 is cemented into one of the straight through openings of shoe "T" coupler 18. A foot 3 preferably made of plasticized rubber is then fitted over the free end of housing 23, the end opposite to the location where housing 23 was cemented to shoe "T" coupler 18. Foot 3 fits into the heel of the footwear to be dried such as B in FIG. 1 and helps protect the interior of the foot wear. Shoe bracket actuator housing (front) 21 is cemented into the remaining unused opening of the shoe "T" coupler 18.

Figure 2:
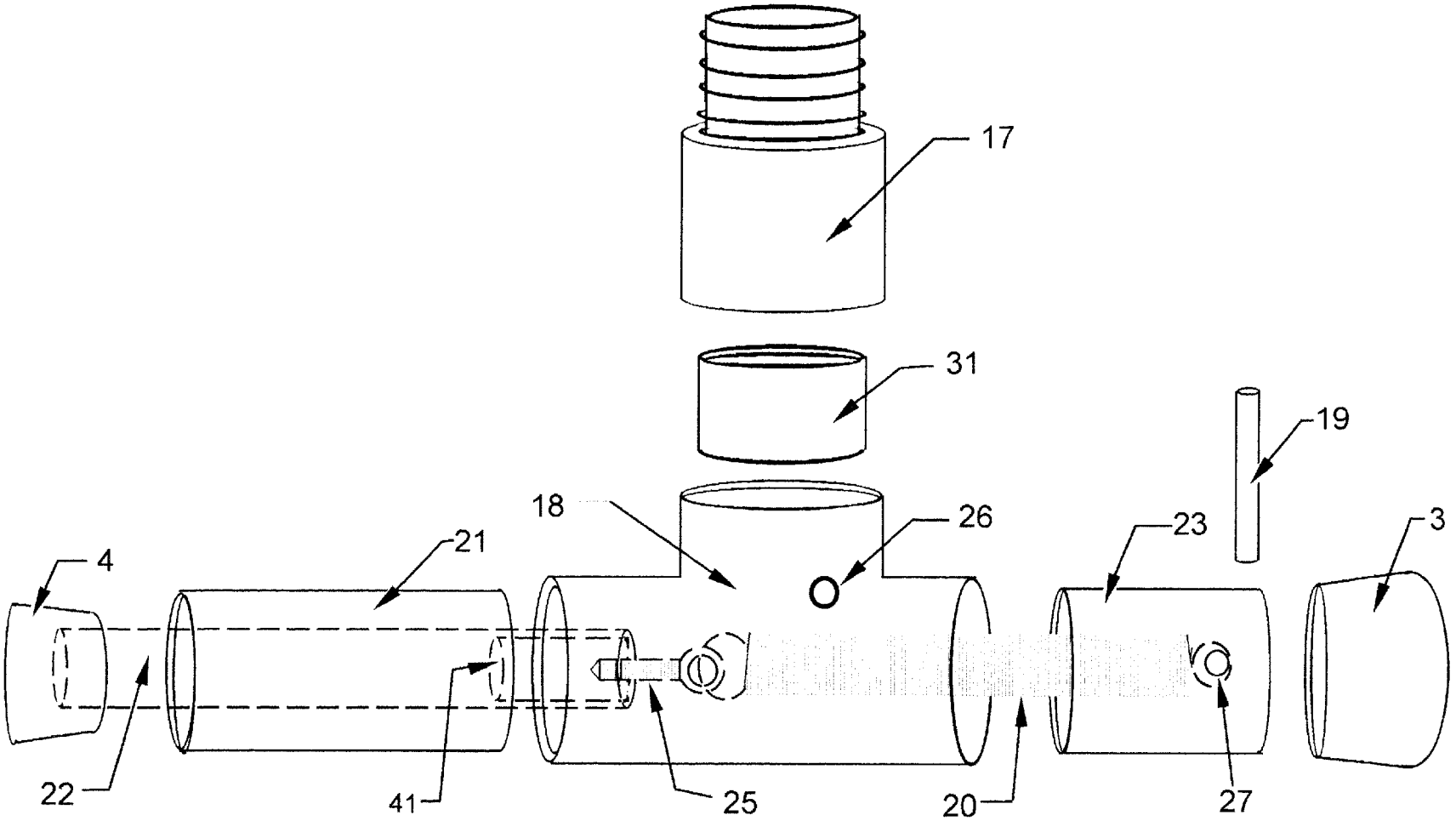
FIG. 2 is a detailed exploded view of the shoe bracket subassembly shown as "A" in FIG. 1.

Further shown in FIGS. 1 and 2, a 3" length of wood dowel 41 is inserted into one end of shoe bracket plunger 22 until the two faces are even and cemented in place. A spring fastener (screw eye) 25 is screwed into the exposed face of wood dowel 41. FIG. 7 is a side view of dowel 41, plunger 22 which is similar to plunger 15, and fastener 25. Plunger 22 and fastener 25 are then attached to one of the connection loops of spring 20.

The unused end of the spring 20, fastener 25, and plunger 22 combination is then inserted into the open end of shoe bracket actuator housing (front) 21 then fastened to the actuator housing (rear) 23 at hole 27, a ⅛" inch hole drilled through housing (rear) 23, ½" from the free end housing 23, by inserting a spring pin 19 through hole 27, spring 20, out the opposite side of housing (rear) 23.

A foot 3 fits over the end of the housing 23 at location of hole 27 and keeps pin 19 from falling out. Foot 3 is the end of shoe bracket A, FIG. 1, that fits into the heel of the footwear to be dried, B of FIG. 1. A ½" foot 4 is fitted to the end of plunger 22. Foot 4 is on the end of shoe bracket sub-assembly A that fits into the toe section of the footwear to be dried and helps prevent damage to the interior of the footwear. There are a total of four shoe bracket subassemblies A having an identical configuration as shoe bracket subassembly "A" FIG. 1 in the preferred PVC embodiment.

Although the female coupler 16 is shown in FIG. 1 as attached to hub 9, and male coupler 17 is shown in FIG. 1 as attached to shoe "T" coupler 18, it is contemplated that the positions of the male and female couplers could be reversed such that male coupler 17 could be attached to hub 9, and female coupler 16 could be attached to shoe "T" coupler 18. These contemplated changes in the positions of the female coupler 16 and male coupler 17 will not affect form, fit, or function of the PVC embodiment of the footwear dryer rack. Also, although the male coupler 17 and female coupler 16, as pictured in FIG. 1 are configured as ¾" PVC couplers, these same couplers could be configured as ⅝" PVC couplers. Shoe "T" coupler 18 would then be configured as a ⅝" shoe "T" coupler 18 and actuator housing (front) 21 and actuator housing (rear) 23 would be configured of ½" PVC tubing with plunger 22 formed from ⅜" hardwood doweling.

The rack holders 24 shown in FIG. 1, keep the present invention stationary in dryer drum 28 during use. Although double sided self-stick tape 36 fixed to the back of each rack holder 24 is the preferred means for mounting the present invention within a dryer drum 28, it is within the scope of the present invention to have other mounting means for rack holder 24. The rack holders 24 are mounted onto opposite, inside surfaces of dryer drum 28 by removing the paper backing from each piece of self-stick tape 36 and firmly pressing each rack holder 24 onto opposed positions on drum 28.

Hot air vent holes 26 are drilled into the shoe "T" couplers 18 at the approximate position depicted in FIGS. 1 and 2. These vent holes 26 help to circulate dryer hot air to the inside of the footwear being dried. Although not shown, it is contemplated to have additional vent holes 26. However, the number of vent holes 26 should not be so numerous as to weaken the structure of shoe "T" coupler 18.

It is also contemplated for the present invention to have a second preferred embodiment of the footwear drying rack comprising aluminum materials as shown in FIGS. 4, 6, 8, and 10. FIGS. 4, 6, 8, and 10 can be used to follow the description of the construction of the aluminum embodiment of the footwear drying rack. Sliding actuator arm 5 is constructed of ½" diameter aluminum tubing. The purpose of sliding actuator arm 5 is to extend the length of the dryer rack to fit various diameters of automatic dryer drums 28.

Sliding actuator housing 6 allows for the adjustment of the length of the dryer rack by providing an anchor point for sliding actuator arm 5. Once the diameter of the dryer drum 28 has been determined, ⅛" diameter predrilled holes including 8*b* located approximately 2.000" from the end of actuator arm 5, hole 8*c* located approximately 3.125" from the end of actuator arm 5, and hole 8*a* located approximately 0.750" from the end of actuator housing 6 respectively, are fixed at that position by inserting actuator housing pin (⅛" diameter×¾" steel clevis pin) 7 into hole 8*a* then through either hole 8*b* or 8*c*. The clevis is then inserted into the hole in pin 7 until it locks into pin 7.

Figure 6:
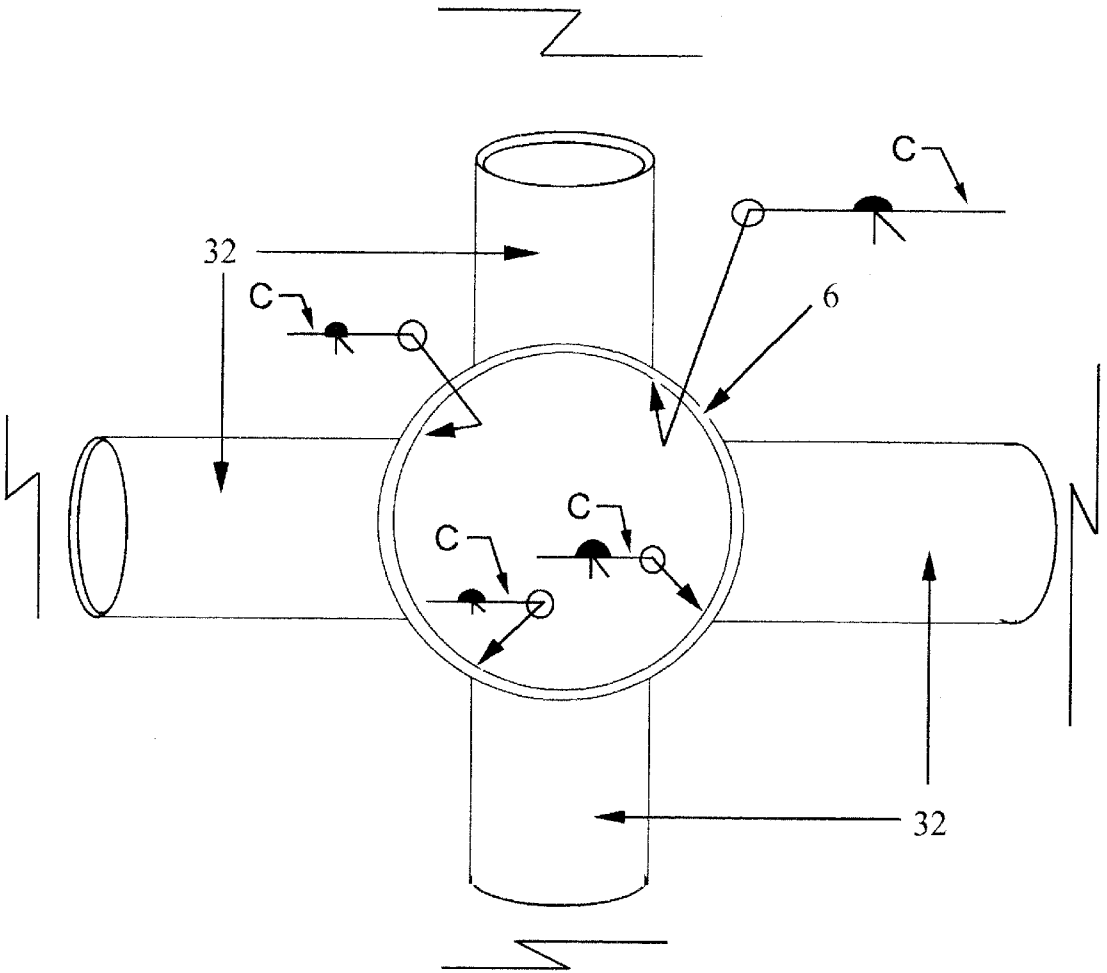
FIG. 6 is a front view of the hub of the second embodiment of the invention.

Four ½" diameter×5" length aluminum tubes, used to comprise shoe bracket inside slider arms 32 are welded radially at right angles to sliding actuator housing 6, see "C" in FIG. 6. A fillet weld is to be used and there must be complete penetration of the base metal with no cavitations. FIG. 6, shows the approximate position of arms 32 to housing 6. This comprises the hub of the aluminum dryer rack. These four arms 32 will be the arms 32 over which the shoe bracket outside slider arms 33 will fit and which facilitate length adjustment of arms 32 and 33 to the appropriate height of the footwear to be dried. Main spring actuator housing 13 is fitted into the hub end of sliding actuator housing 6, approximately one-half inch, and welded to housing 6 at that point, see FIG. 4.

One end of the main (compression) actuator spring 14 is attached to the end of main actuator plunger 15 that has been notched to accept attachment of spring 14. The opposite end of spring 14 is fitted into the open end of main spring actuator housing 13 and attached inside housing 13 to hole 10 that has been drilled through housing 13 at a point approximately 1½" from the welded joint, the hub was previously described, and fixed in place by male and female parts of a two-part main actuator spring fastener, 11 and 12 respectively.

Figure 4:
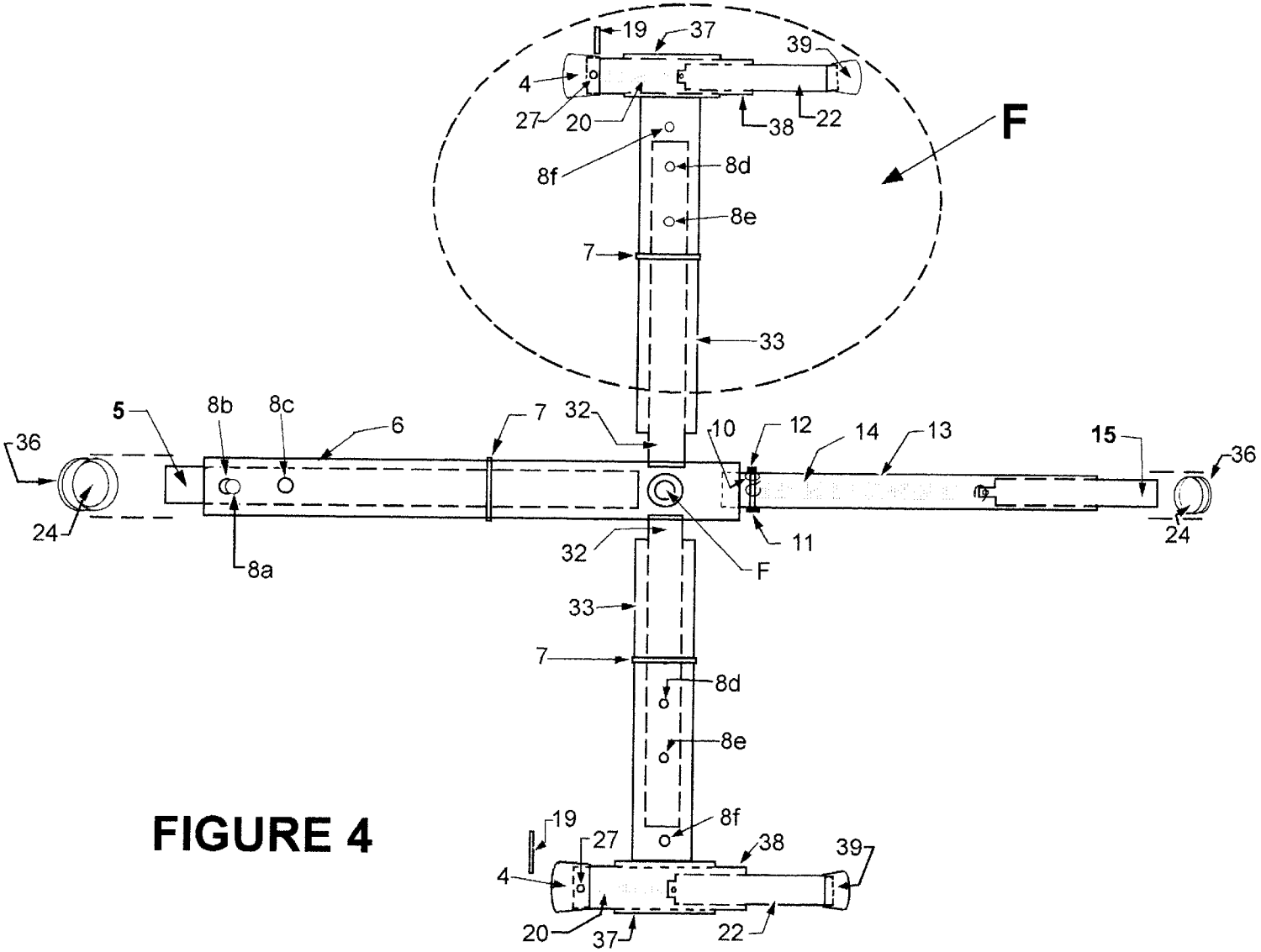
FIG. 4 is a top view of the second preferred embodiment of the invention that is fabricated utilizing aluminum materials.

The next step in constructing the aluminum embodiment of the footwear dryer rack is the construction of shoe bracket subassembly "F" of FIG. 4. One end of shoe bracket outside slider arm 33, the end closest to hole 8*f* (reference FIGS. 4 and 10) is welded, FIG. 10 "C", at a ninety degree angle to a point 1.137" from one end of shoe bracket actuator—main housing 37. Shoe bracket actuator—secondary housing 38 (reference FIGS. 4 and 8) is then inserted into main housing 37 with one end projecting approximately one and one-half inches beyond one end of main housing 37 and radially welded to main housing 37 at two places (shown as "C" welds of FIG. 8). One end of shoe bracket spring 20 is then attached to the loop on one end of shoe bracket plunger 22 that has been notched to accept attachment of spring 20, FIG. 8. Shoe bracket spring 20 and plunger 22 are then inserted into housing 38 until the end of the spring 20 reaches the location of hole 27. The location of hole 27 is approximately ½" from the open end of housing 38. The spring 20 is now fixed at the location of hole 27 by inserting shoe bracket spring pin 19 (reference critical dimensions and tolerances chart) into hole 27, through the end loop in spring 20, and out the other side of hole 27.

A ½" diameter foot 4 is fitted onto end of housing 38 at the location where spring pin 19 was inserted through hole 27. Foot 4 covers hole 27, and prevents pin 19 from falling out of hole 27. Foot 4 fits into the heel area of the footwear to be dried, in the same manner as foot 3 of FIG. 1, and helps prevent internal damage or wear to the footwear being dried.

A ⅜" foot 39 is fitted onto the free end of plunger 22. This foot 39 is inserted into the toe area of the footwear to be dried, in the same manner as foot 4 of FIG. 1, and helps prevent internal damage or wear to the footwear being dried.

The open end of shoe bracket outside slider arm 33 is then placed upon the open end of shoe bracket inside slider arm 32 and fitted down the length of inside slider arm 32. The overall length of shoe bracket slider arms 32 and 33 is determined by the height of the footwear to be dried, similar to "B" of FIG. 1. They are fixed at the desired length relative to one another by inserting clevis pin 7 (reference—critical dimensions and tolerances chart) into hole 8*f* then through either holes 8*d* or 8*e*. The clevis is then inserted into clevis pin 7 to its stop location to prevent clevis pin 7 from falling out of holes 8*f*, 8*d* or 8*e* respectively when drying footwear in rotating drum 28.

Although slider arm 32 (as described in the following critical dimensions and tolerances chart) is comprised of 0.500" inside diameter round aluminum tubing and slider arm 33 is comprised of 0.625" inside diameter aluminum round tubing. It is also contemplated that slider arm 32 could be comprised of 0.625" inside diameter aluminum round tubing and slider arm 33 could be comprised of 0.500" inside diameter aluminum round tubing. Further, it is contemplated that the round tubing used in the aluminum embodiment of the present invention could be configured with 0.625" square tubing and 0.500" square tubing respectively. In addition, the aluminum plungers 15 and 22 could be configured using 0.437" square tubing respectively.

Three more shoe bracket subassemblies similar to the shoe bracket subassembly as shown in FIG. 4 subassembly "F" that make up the completed dryer rack, are assembled in the same manner as described above and shown in FIG. 4. subassembly "F".

The rack holders 24 shown in FIG. 4, keep the invention stationary in the dryer drum 28 during use. Although double sided self-stick tape 36 fixed to the back of each rack holder 24 is the preferred means for mounting the present invention within a dryer drum 28, it is within the scope of the present invention to have other mounting means for rack holder 24. The rack holders 24 are mounted onto opposite, inside surfaces of dryer drum 28 by removing the paper backing from each piece of self-stick tape 36 and firmly pressing each rack holder 24 onto opposed positions on drum 28.

The rack holders 24, used to support the second embodiment of the present invention as shown in FIG. 4, and keep the invention from moving in dryer drum 28 are configured and dimensioned in an identical manner as the rack holders 24 described in FIG. 1.

To use the footwear drying rack (invention) in an automatic dryer, the rack holders 24 have to be positioned on the inside, centered, opposing walls of drum 28. Remove sliding actuator housing pin 7 from sliding actuator housing hole 8*a*, FIG. 1. Before inserting the rack into drum 28 measure the furthest inside diameter of drum 28. For drums 28 that measure between twenty-three and twenty-five inches in diameter insert pin 7 into sliding actuator housing hole 8*a*, through hole 8*b* of sliding actuator arm, then, out the opposite side of siding actuator housing hole 8*a*. For drums 28 that measure twenty-six or more inches in diameter insert sliding actuator housing pin 7 into sliding actuator housing hole 8*a*, through hole 8*c* of sliding actuator arm, then, out the opposite side of sliding actuator housing hole 8*a*. Insert the drying rack into drum 28. Position the two opposed main actuator feet 4 of rack in dryer drum 28 at two furthest opposing sides of drum 28 and at a position half way between the front and back of drum 28. Mark the location of the two opposing feet 4 on the inside of the drum 28. Remove the rack from the dryer drum 28. Peel the paper backing from the back of the two rack holders 24 which are then placed over the marks made on the inside of drum 28. Press each rack holder 24 firmly onto it's respective mark on drum 28. Slightly jiggle each rack holder 24 to verify a good bond. When using the PVC embodiment, slip the end of one shoe bracket subassembly "A" of FIG. 1 that has foot 4 on the end into the toe area of footwear "B". Then fit foot 3 of the same shoe bracket subassembly "A" into the heel area of footwear "B". When using the aluminum embodiment of the present invention, slip the end of shoe bracket subassembly "F" having foot 39, into the toe area of the footwear to be dried. Fit foot 4 into the heel area of the footwear to be dried. The footwear rack would then be ready for insertion into dryer drum 28. When using the PVC embodiment of the invention, fit foot 4, that is attached to the main actuator plunger 15, into one of the rack holders 24. While applying pressure towards plunger 15 end of the rack, slip foot 4 on the end of the sliding actuator arm 5 into the opposite rack holder 24.

When using the PVC embodiment of the present invention for drying footwear, simultaneous drying of loose items of laundry should not also be attempted. Laundry added to drum 28 will elevate the temperature of the heated air in drum 28, possibly to the level where the PVC materials of the footwear drying rack can become softened. However, sole use of the PVC embodiment of the present invention in drum 28, even for an extended period of time, does not weaken or damage it in any way.

Although the previous discussion and the following chart describe examples of critical dimensions, preferred materials, and acceptable tolerances for two preferred embodiments, it is also within the scope of the present invention to include other embodiments with differing materials, dimensions, and tolerances. The following are critical dimensions and tolerances suggested for the first and second preferred embodiments of the present footwear drying rack invention.

| COMPONENT LIST NUMBER | PART NAME | FIG. # | CRITICAL DIMENSION | TOLERANCE |
|---|---|---|---|---|
| 15 | main actuator plunger | 1 | 7.000" l. × 0.500" d. | ±0.125 |
| 15 | main actuator plunger | 4 | 7.000" l. × 0.437 d. | ±0.125 |
| 14 | main actuator spring | 1 | 9.000" l. × 0.500 d. | ±0.000 |
| 14 | main actuator spring | 4 | 9.000" l. × 0.0437" d. | ±0.000 |
| 32 | inside slider arm | 4 | 5.000" l. × 0.500" d. | ±0.125" |
| 33 | outside slider arm | 4 | 5.250" l. × 0.625 d. | ±0.125" |
| 37 | actuator main housing | 4 | 2.750" l. × 0.625" d. | ±0.125" |
| 38 | actuator secondary housing | 4 | 5.000" l. × 0.500" d. | ±0.125 |
| 22 | shoe bracket plunger | 4 | 6.500' l. × 0.437" d. | ±0.125" |
| 27 | spring fastener hole | 4 | 0.250" from heel section of housing 38 | ±0.125" |
| 29 | hub washer | 3 | 5/8" diameter | stock item |
| 21 | actuator housing (front) | 1 | 1.750" l. × .750" d. | ±0.125" |
| 23 | actuator housing (rear) | 1 | 2.500" l. × .750" d | ±0.125" |
| 22 | shoe bracket plunger | 1 | 7.000" l. × 0.500" d. | ±0.125" |
| 41 | wood dowel | 1 | 3.000" l. × 0.500" d. | ±0.125" l. |
| 19 | pin-aluminum | 1 | 0.750" l. × 0.125" d. | stock item |
| 7 | clevis pin-aluminum | 1 | 0.750" l. × 0.125" d. | stock item |
| 7 | clevis pin-aluminum | 4 | 0.500" l. × 0.125" d. | stock item |
| 19 | pin-aluminum | 4 | 0.500" l. × 0.125" d. | stock item |

Also, provided below is a summary listing of all of the components and subassemblies identified in FIGS. 1–10 herein, which also includes the numeric designation given to each component and the number of each component needed to construct the first and second preferred embodiments.

COMPONENT LIST

1. First embodiment of invention - PVC - FIG. 1.
2. Second embodiment ofi nvention - Aluminum - FIG. 4
3. 3/4" foot - 4 ea.
4. 1/2" foot - 6 ea.
5. Sliding actuator arm - 1 ea.
6. Sliding actuator housing - 1 ea.
7. Sliding actuator housing pin - 1 ea.
8. Sliding actuator arm/housing fastener holes - 3 ea.
9. Six-way hub- 1 ea.
10. Main spring housing fastener hole - 1 ea.
11. Female part of main actuator spring fastener - 1 ea.
12. MaIe part of main actuator spring fastener - 1 ea.
13. Main spring actuator housing - 1 ea.
14. Main actuator spring - 1 ea.
15. Main actuator plunger - 1 ea.
16. 3/4" female PVC coupler - 4 ea.
17. 3/4" male PVC coupler - 4 ea.
18. Shoe bracket "T" coupler - 4 ea.

-continued

| | |
|---|---|
| 19. | Shoe bracket spring pin - 4 ea. |
| 20. | Shoe bracket spring - 4 ea. |
| 21. | Shoe bracket actuator housing (front) - 4 ea. |
| 22. | Shoe bracket plunger - 4 ea. |
| 23. | Shoe bracket actuator housing (rear) - 4 ea. |
| 24. | Rack holders - 2 ea. |
| 25. | Spring fastener - 5 ea. |
| 26. | Vent - hot air - 5 ea. |
| 27. | Shoe bracket spring fastener hole - 4 ea. |
| 28. | Rotating dryer drum. |
| 29. | Hub washers - 2 ea. |
| 30. | Hub bolt - 1 ea. |
| 31. | PVC 1" l. × 3/4 d. approx. - connector 6 ea. |
| 32. | Shoe bracket inside slider arm - aluminum - 4 ea. |
| 33. | Shoe bracket outside slider arm - aluminum - 4 ea. |
| 34. | — |
| 35. | 3/4" diam - washer lock ring - 2 ea. |
| 36. | Double sided self-stick adhesive tape |
| 37. | Shoe bracket actuator - main housing - 4 ea. |
| 38. | Shoe bracket actuator - secondary housing - 4 ea. |
| 39. | 3/8" foot - 4 ea. |
| 40. | 1/8" nut - 1 ea. |
| 41. | 3" l. × 1/2" d. wood dowel |

SUB-ASSEMBLY LISTING

| | |
|---|---|
| A, F | Shoe bracket subassembly FIGS. 1 and 4, respectively. |
| B. | Representation of one piece of footwear on one shoe bracket assembly FIG. 1. |

What is claimed is:

1. A support structure for drying footwear within the rotating drum of an automatic clothes dryer, said support structure comprising one outwardly-biased main actuator arm;

one telescoping main actuator arm connected to said outwardly-biased main actuator arm so that said outwardly-biased main actuator arm and said telescoping main actuator arm are axially aligned with one another to form a main actuator arm with opposite ends;

a first connection means to attach said outwardly-biased main actuator arm and said telescoping main actuator arm to one another;

a plurality of outwardly-biased footwear brackets connected to said main actuator arm and supported in a spaced-apart relation from one another, each of said footwear brackets having opposed ends;

a second connection means for fixedly attaching said footwear brackets to said main actuator arm;

a pair of rack holders each having a back surface configured for mounting against said dryer drum;

mounting means for adhering each of said rack holders to opposite sides of said dryer drum; and a plurality of resilient feet configured for placement over said opposite ends of said main actuator arm, as well as for placement over said opposed ends of said footwear brackets, to provide non-slip positioning of said main actuator arm between said rack holders when said rack holders have been securely mounted within said rotating drum and to provide secure non-damaging positioning of said opposed ends of each of said footwear brackets within one piece of said footwear during use of said support structure to dry said footwear within an automatic clothes dryer.

2. The support structure of claim 1 wherein said first connection means comprises a six-way hub.

3. The support structure of claim 2 wherein for connection of each of said footwear brackets to said six-way hub said second connection means comprises a female coupler internally threaded on one of its ends, a male coupler having external threads on one of its ends configured for secure connection to said internally threaded end of said female coupler, and a connector, and wherein said connector is attached between said male coupler and said footwear bracket.

4. The support structure of claim 3 further comprising two additional connectors, two hub washers, two washer lock rings, a hub bolt, and a hub nut, and wherein two of said female couplers are each connected to said six-way hub by one of said additional connectors and the remaining two of said female couplers are each connected against said six-way hub with said hub washers, said washer lock rings, said hub bolt, and said hub nut.

5. The support structure of claim 1 wherein for connection of each of said footwear brackets to said main actuator arm said second connection means comprises an inside slider arm attached to said main actuator arm, an outside slider arm positioned over said inside slider arm and attached on one end to said footwear bracket, a plurality of fastener holes through both said inside slider arm and said outside slider arm, and a pin configured for secure positioning within a selected one of said fastener holes in said inside slider arm as well as for simultaneous secure positioning within a selected one of said fastener holes in said outside slider arm.

6. The support structure of claim 1 wherein each of said footwear brackets comprises a hollow T-shaped footwear connector having opposed first and second ends, as well as a third end positioned at right angles to said first and second ends, and which is configured for attachment of said footwear bracket to said second connection means, a front actuator housing axially aligned with and attached to said first end of said T-shaped coupler; a footwear bracket plunger slidably positioned within said front actuator housing and having an inner end and an outer end; a rear actuator housing axially aligned with said front actuator housing and attached to said second end of said T-shaped coupler, said rear actuator housing having a fastener hole therethrough and a distal end; a footwear bracket pin; a footwear bracket spring fastener; a footwear bracket spring positioned within said rear actuator housing and a portion of said T-shaped coupler, said footwear bracket spring having a front end and a rear end, said front end of said footwear spring being attached to said inner end of said footwear bracket plunger with said footwear bracket spring fastener, said rear end of said footwear spring being attached to said rear actuator housing by said footwear bracket pin being inserted into said fastener hole through said rear actuator housing; and each of said footwear brackets also comprising a smaller foot made from resilient material which is attached over said outer end of said footwear bracket plunger for positioning against the toe of a piece of footwear during drying of said footwear on said support structure, and a larger foot made from resilient material attached over said distal end of said rear actuator housing for positioning against the heel of a piece of footwear during drying of said footwear on said support structure.

7. The support structure of claim 6 further comprising a dowel connected between said footwear bracket spring and said footwear bracket plunger.

8. The support structure of claim 6 wherein said T-shaped couplers each have a plurality of vent holes therethrough.

9. The support structure of claim 1 wherein said outwardly biased main actuator arm comprises a main actuator spring having opposite ends, a main actuator spring housing, a main actuator plunger, a spring fastener, and a two-part spring fastener, one of said opposite ends of said main actuator spring being attached to said main actuator plunger with said spring fastener, and the other of said opposite ends of said main actuator spring being attached to said main spring actuator housing with said two-part spring fastener.

10. The support structure of claim 9 further comprising a dowel connected between said main actuator spring and said main actuator plunger.

11. The support structure of claim 1 wherein said telescoping main actuator arm comprises a sliding actuator arm with a plurality of holes therethrough, a sliding actuator housing with at least one hole therethrough, and a sliding actuator housing pin configured for secure positioning within said holes to prevent inadvertent movement of said sliding arm relative to said sliding actuator housing.

* * * * *